US006973700B2

(12) United States Patent
Hsiao

(10) Patent No.: US 6,973,700 B2
(45) Date of Patent: Dec. 13, 2005

(54) PAPER CLIP

(76) Inventor: Ray-Ling Hsiao, 4F, No. 12, Aly.15, Ln.175, Sec.2, Ho Ping E. Rd., Taipei (TW)

( * ) Notice: Subject to any disclaimer, the term of this patent is extended or adjusted under 35 U.S.C. 154(b) by 48 days.

(21) Appl. No.: 10/649,916

(22) Filed: Aug. 28, 2003

(65) Prior Publication Data

US 2004/0045137 A1 Mar. 11, 2004

Related U.S. Application Data

(63) Continuation-in-part of application No. 10/002,204, filed on Dec. 5, 2001, now abandoned.

(51) Int. Cl.[7] ..... B42F 1/02

(52) U.S. Cl. ..... 24/67.9; 24/67.1; 24/545

(58) Field of Search ..... 24/67 R, 67.3, 24/67.9, 67.11, 67 CF, 511, 545, 547, 457, 563; 40/658, 666; 281/42, 45, 46; 402/80 R, 80 P; D8/394, 395, 371; D11/78.1, 200, 215; D19/32, 34, 65

(56) References Cited

U.S. PATENT DOCUMENTS

| | | | | | |
|---|---|---|---|---|---|
| 213,306 | A | | 3/1879 | Stieglitz | 40/652 |
| D24,073 | S | | 2/1895 | Smith | D19/65 |
| 584,761 | A | | 6/1897 | Eaton | 434/88 |
| D63,435 | S | | 12/1923 | Roy | D11/215 |
| 1,886,882 | A | | 11/1932 | Huber | 24/698.1 |
| 2,779,114 | A | | 1/1957 | Orthwine | 40/658 |
| 3,502,251 | A | * | 3/1970 | Hart | 223/96 |
| 3,950,823 | A | | 4/1976 | Schreter | 24/66.13 |
| 4,761,935 | A | | 8/1988 | King | 53/416 |
| D311,212 | S | * | 10/1990 | Tsuji | D19/65 |
| 4,991,806 | A | | 2/1991 | Nakamura | 248/206.2 |
| 5,056,748 | A | | 10/1991 | Meyer | 248/316.7 |
| 5,113,554 | A | | 5/1992 | Gallo | 24/545 |
| 5,179,765 | A | * | 1/1993 | Sungberg | 24/67.9 |
| 5,214,825 | A | * | 6/1993 | Hirzel | 24/67.9 |
| 5,704,724 | A | | 1/1998 | Karlis | 402/79 |
| D407,517 | S | | 3/1999 | Zeller | |
| 6,254,136 | B1 | | 7/2001 | Patel | 281/42 |
| D464,994 | S | * | 10/2002 | Rosen | D19/65 |
| 6,698,695 | B1 | * | 3/2004 | Spoto | 24/567 |

FOREIGN PATENT DOCUMENTS

| | | | |
|---|---|---|---|
| DE | 24 32 880 | 7/1974 | 24/67.9 |
| DE | 3331729 A1 | 9/1983 | 24/67 R |
| FR | 978127 | 4/1951 | 24/67.9 |
| FR | 2 605 127 | 4/1988 | |
| GB | 2 254 291 A | 7/1992 | |

* cited by examiner

*Primary Examiner*—Robert J. Sandy
*Assistant Examiner*—Ruth C. Rodriquez
(74) *Attorney, Agent, or Firm*—Troxell Law Office, PLLC

(57) ABSTRACT

The present invention relates to an improved paper clip which is suitable for holding documents of different thicknesses. The improved paper clip includes three elements, which are a first clipping piece, a second clipping piece and a support beam. The first clipping piece is formed with a sunken slot therethrough and is connected to a bottom side of the support beam. The second clipping piece has a bending curve part and is connected to a top side of the support beam. The bending curve part is partially protruding into the sunken slot and is roughened to become a rough surface for increasing friction to tightly clamp documents. The inner surface of the support beam is a flat plane so as to provide a guiding function when the document is received between the first and second clipping pieces. The first and second clipping pieces are both adjoined to the inner surface of the support beam, such that the outer surface of the support beam substantially forms part of the outer contour of the paper clip.

9 Claims, 9 Drawing Sheets

PAPER CLIP

CROSS-REFERENCE TO RELATED APPLICATION

This application is a continuation-in-part of U.S. patent application Ser. No. 10/002,204 filed on Dec. 5, 2001 now abandoned.

FIELD OF THE INVENTION

The present invention is an improved paper clip; especially it is for clamping different thicknesses of documents.

BACKGROUND OF THE INVENTION

Traditionally, most kinds of paper clips are made of steel wires. It is very convenient for clipping documents and especially for papers. Referring to FIG. 1, which is the 3-dimension view of prior art and normally made of plastic, because plastic is a flexible material. A bottom surface of paper 4 is put on first clipping piece 1, and second clipping piece 2 is above a top surface of paper 4, which means paper 4 is within the first clipping piece 1 and the second clipping paper 2. Top edge 40 is against to joint place 3, thus the paper 4 can be clamped tightly. The first clipping piece 1 and the second clipping piece 2 are located at the same horizontal plane, which means joint place 3 is no height difference. Therefore, this type of paper clip as in FIG. 1 is just suitable for thin thickness of document, such as one paper or only a couple of papers; on the other hand, a thick document is not tightly clamped.

Referring to FIG. 2, which is another 3-dimension view of prior art. This is an advance type of clip. First clipping piece 5 and second clipping piece 6 are not on the same horizontal plane, and support beam 7 is with a height, therefore the height has a capacity for thicker (documents, but the prior art cannot be tightly enough to clamp one piece of paper, because touching line 8 of the first clipping piece 5 and the second clipping piece 6 is formed as a line, thus the clamping force is not strong enough.

Referring to FIG. 3, which is the third 3-dimension view of prior art and the oldest but the most convenient prior art, so the shortcomings of the types in FIGS. 1 and 2 are all included in the prior art. Which means that first clipping piece 9 and second clipping piece 10 are at the same horizontal plane, so the prior art is not suitable for thicker documents as well; further, the prior art is made of steel wire as usual, thus the application force for clamping is as two individual lines, so the application condition is just same as the prior art in FIG. 2. Therefore, the prior arts as mentioned above are not good enough to manage the present paper work operations.

U.S. Pat. No. 3,950,823 discloses a tie clasp which is formed from a single sheet of spring metal and comprises primary a base portion and a spring clip portion. The spring clip portion is formed at one end of the base portion and has a curved resilient section area and a free end section area. The base portion is provided with a slot. The central section of the spring clip portion extends inwardly into the slot. The curved resilient section area connects the base portion and the spring clip portion and has the same width as the spring clip portion. The free end section area of the spring clip portion extends out of the front end of the base portion in such a manner that the free end section area of spring clip portion overlaps the front end of base portion in the projection of top view. In addition, the curved resilient section area of the spring clip portion also overlaps the rear end of base portion in the projection of top view. In order to provide sufficient structural strength, the right end of the slot must be apart from the bottom side of the curved resilient section area so as to leave a sufficient width thereof. Such kind of structure makes the tie clasp of U.S. Pat. No. 3,950,823 difficult to be manufactured by plastic ejection, since the overlapped portions of the tie clasp makes it extremely difficult to be taken off from the molds along the top-view direction during the plastic ejecting process. As the result, the tie clasp of U.S. Pat. No. 3,950,823 suffers the deficiency of being difficult to be made by plastic ejection.

U.S. Pat. No. 5,056,748 discloses a molded plastic holder for printed material. The molded plastic holder includes a support panel, curved clip, stiffening rib, open area and mounting holes. The support panel and curved clip are connected at the bottom edge of the curved clip, such that the connecting portion of the bottom edge has exactly the same width as the curved clip. Because the open area is wider than the curved clip, therefore the support panel must has a back portion extending backward from the connected bottom edge in order to provide sufficient structural strength. If this back portion is not large enough, then the effective connection between the support panel and the curved clip will be only at the two ends of the bottom edge and will be prone to break easily. However, since the large back portion is extending in the same plane as the support panel which is substantially perpendicular to the curved concave inner surface of the curved clip, therefore, the back portion of the support panel will extend out of the outer contour of documents which are received and held by the molded plastic holder. In addition, because the curved concave inner surface is the surface where the leading edges of documents will contact, therefore, when lots of documents are received by the holder in the same time, the leading edges of documents tend to become a curved shape in the side view. The leading edges of documents cannot be stacked straightly. Thus the appearance of the holder would be ugly when holding documents.

U.S. Pat. No. 6,254,136 discloses a page holder which includes a spring clip integrally formed with a base. The spring clip has a cavity with substantially parallel edges, an end edge and a curved edge. A tongue is connected to the spring clip at the end edge of the cavity by a connecting member. Similar to the previously described prior art U.S. Pat. No. 5,056,748, the connecting member of U.S. Pat. No. 6,254,136 has a width exactly the same as the tongue. That means, the base of the page holder shown in U.S. Pat. No. 6,254,136 must have a large back portion extending backward from the end edge of cavity. It is impossible to make the base with a back edge being flush with the end edge of the cavity, otherwise the effective connection between the tongue and the base will be only at the two ends of the end edge of the cavity and will be easy to break.

U.S. Pat. No. 5,704,724 discloses a paper clip which is in a flat plane structure. The amount of documents which this paper clip can hold is thus limited. The paper clip disclosed by U.S. Pat. No. 5,704,724 is not suitable for holding lots of documents with significant thickness.

Other conventional clip-like structure, such like the ones illustrated by U.S. Pat. No. 5,113,554, DT 2432880, GE 2254291, and etc., all have similar draw backs as which of the U.S. Pat. No. 5,056,748 and U.S. Pat. No. 6,254,136. That is, all of the conventional clip-like structures include a "tongue" and a "base" and a "connecting member" for connecting the "tongue" and "base". And, the most important thing is, the "connecting member" of these prior arts is always having a width exactly the same as the "tongue", which consequently results in the "base" must have a "back side portion" which extends backward from the "tongue" and cannot lie on the same vertical plane as the "connecting member". As a result, when the clip-like structure of prior art is holding something such like documents, the so called "back side portion" of the "base" will definitely protrude out of the outer contour of the documents. It fails to provide an integral and beautiful appearance to the clip and the documents.

It is notable that, for a clip-like structure like the ones previously described, there are always four primary elements being comprised, namely "tongue", "base", "connecting member" and "slot" located on the "base". In order to provide sufficient structural strength, there must be sufficient thickness or width near the bottom of the "connecting member". For example, for the clip-like structures shown in U.S. Pat. No. 5,113,554 and U.S. Pat. No. 3,950,823, their "slot" does not extend to contact with the "connecting member", such that a sufficient width is formed between the "slot" and the "connecting member" to provide the structural strength required. In the other hand, for the clip-like structures shown in U.S. Pat. No. 5,056,748, U.S. Pat. No. 6,254,136, DT 2432880 and GB 2254291, a "back side portion" of the "base" is formed behind the "connecting member" for providing sufficient width for the connection between the "base" and "connecting member", such that the structural strength thereof would meet the needs.

BRIEF DESCRIPTION OF THE INVENTION

The first object of the present invention is to offer an improved paper clip to have a function for clamping thicker documents. The present invention supplies a capacity for storing thicker documents, and also the thickness of the capacity is variable, thus the present invention can be widely applied on paper work.

The second object of the present invention is to offer an improved paper clip to have a function for enough clamping force to even one piece of paper.

The third object of the present invention is to provide a paper clip which comprises a first clipping piece, a second clipping piece and a support beam for connecting the first and second clipping pieces. The support beam has a width which is the same as the first clipping piece and larger than the second clipping piece. The first clipping piece is connected to a first connecting portion at the bottom (lower) side of the support beam. The second clipping piece is connected to a second connecting portion at the top (upper) side of the support beam. The first portion and the second portion of the support beam do not overlap with each other in the projective direction of top-view. The support beam forms a back side plane of the whole paper clip such that the back side contour of the paper clip will be flush with the documents when holding them. Therefore provides a pleasing and integral appearance.

For your esteemed review committee members to further understand and recognize the object, the characteristic and the function of the present invention, a detailed description with corresponding diagrams are presented as following:

DETAILED DESCRIPTION OF THE PREFERRED EMBODIMENT

Figure 1:
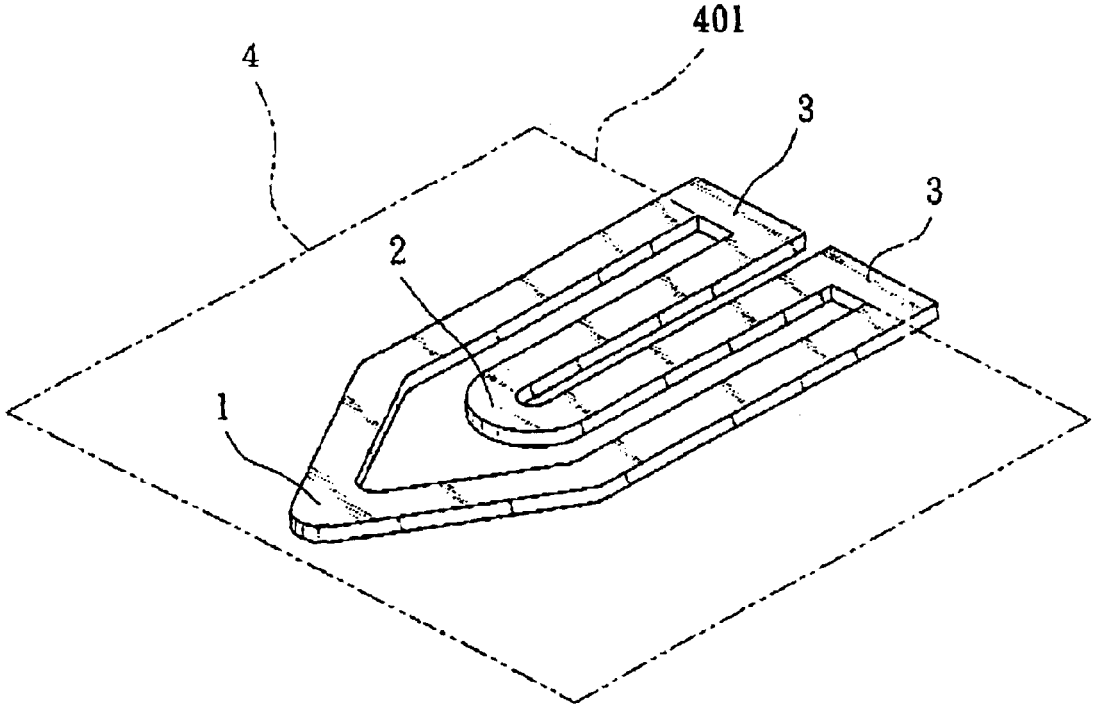
FIG. 1 (PRIOR ART)
FIG. 1 is the 3-dimension view of prior art.
Figure 2:
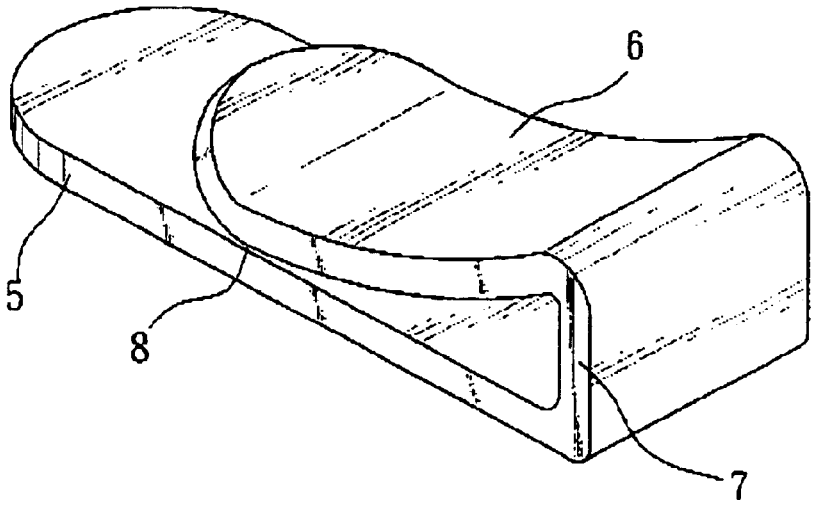
FIG. 2 (PRIOR ART)
FIG. 2 is another 3-dimension view of prior art.
Figure 3:
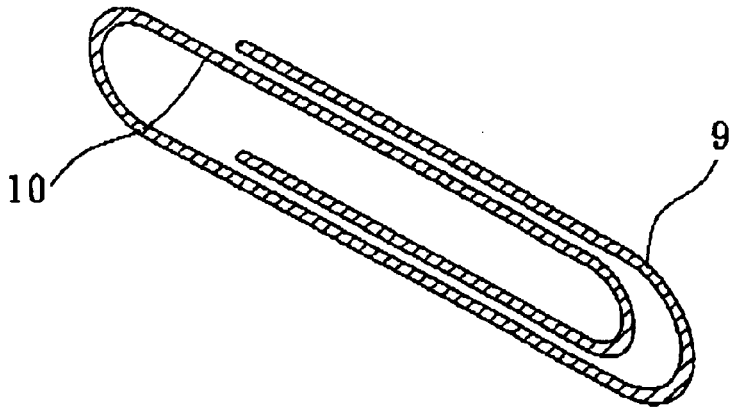
FIG. 3 (PRIOR ART)
FIG. 3 is the third 3-dimension view of prior art.
Figure 4:
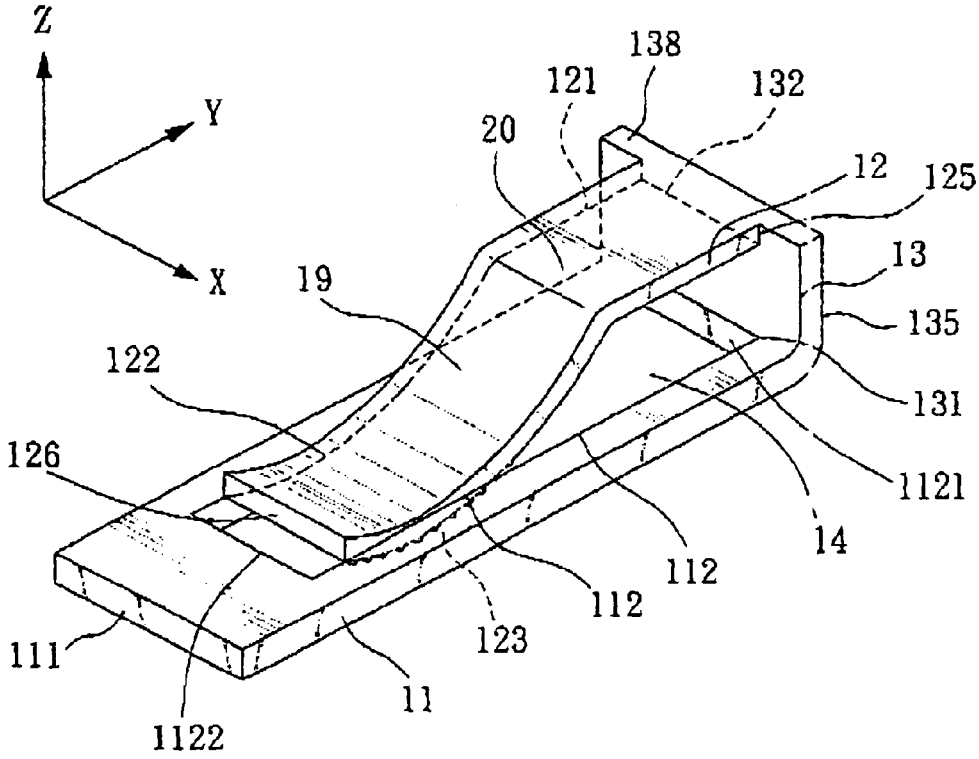
FIG. 4 is the 3-dimension view of the preferred embodiment of the present invention.

Referring to FIG. 4, which is the 3-dimension view of the first preferred embodiment of the present invention. The improved paper clip is made of plastic or steel. A first clipping piece 11 with thin plane shape for placing document is almost parallel to a top surface 121 of a horizontal part 20 of a second clipping piece 12, and which is a lower part of the paper clip of the first preferred embodiment. The second clipping piece 12 with thin plane shape is an upper part of the paper clip of the first preferred embodiment. The first clipping piece 11 is larger than the second clipping piece 12 in both length directions (i.e., the "Y" direction indicated in FIG. 4) and width direction (the "X" direction shown in FIG. 4). The support beam 13 is substantially a vertical plate for connecting with both the first and second clipping pieces 11, 12. The first clipping piece 11 connects to a first connecting portion 131 (also referred as connected end hereinafter) located at the two side-sections of the bottom side 137 of the support beam 13. The second clipping piece 12 is connected to a second connecting portion 132 located at the center-section of the top side 138 of the support beam 13. The first clipping piece 11 further has a sunken slot 112 formed thereon. One end 1121 (e.g., rear end) of the sunken slot 112 is flush with the first connecting portion 131 (connected end) of the support beam 13, which, the other end 1122 (e.g., front end) thereof is apart from the front edge 111 of the first clipping piece 11. That is, the rear end 1121 of the slot 112 is flush with the inner surface 136 of the support beam 13. The support beam 13 has a width in the "X" direction shown in FIG. 4, which is substantially he same as the width of the first clipping piece 11. The second clipping piece 12 is a tongue-like structure having a fixed end 125 connected to the second connecting portion 132 of the support beam 13 and a free end 126 extending toward but apart from the front end 1122 of the sunken slot 112. Support beam 13 with a certain height is almost vertical to both first clipping piece 11 and the top surface 121 and individually connects to one end of each clipping piece, also, the support beam 13 with certain height is available for different thickness of documents. An outer surface of the support beam 13 may be a curve surface or a plane. The second clipping piece 12 is also formed with a bending curve part 19 with a downward curve, and the top curve surface 122 and a bottom curve surface 123 forming an upward curve. The bottom curve surface 123 protrudes down into the sunken slot 112 of first clipping piece 11. The sunken slot 112 is a hollow type. Obviously, there is a capacity 14 among a horizontal section of second clipping piece 12, support beam 13 and first clipping piece 11, which is for storing thicker documents.

Figure 5:
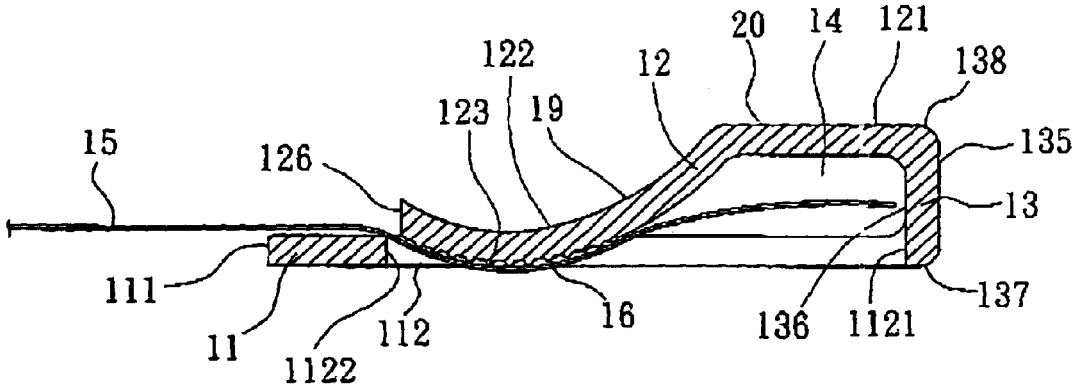
FIG. 5 is the side view of the preferred embodiment of the present invention.

Referring to FIG. 5, which is the side view of the preferred embodiment of the present invention. The bottom surface 123, is roughened to become a roughened surface 16. As showing in the figure, a paper 15 is clamped in sunken slot 112, and because of the roughened surface 16, the paper 15 is tightly fixed and clamped there. In another words, the paper clip is suitable for even one single paper.

It is notable that, when taking a top-side view of the paper clip (along the "Z" axis) shown in FIG. 4, the projections of the first connecting portion 131 and the second connecting portion 132 of the support beam 13 do not overlap each other. Moreover, the projections of second clipping piece 12, support beam 13 and first clipping piece 11 in the top-side view will not overlap with each other as well. Such kind of structural arrangement allows the outer surface 135 of the support beam 13 becoming part of the outer contour of the whole paper clip. In addition, it will be easy to manufacture the paper clip by plastic ejection since such kind of structure is very easy to be released from the molds. Moreover, when lots of documents with significant thickness are received between the first and second clipping pieces 11, 12, the leading edge of the documents can contact with the plane inner surface 136 of the support beam 13. Not only the inner surface 136 provides a guide to make the leading edge of the documents stacked straightly, but also the support beam 13 (e.g., the back-side contour of the paper clip) is flush with the leading edge of the documents. There is no need to extend the back side (right side) of the first clipping piece 11 out of the outer surface 135 of support beam 13, which otherwise might be needed by those aforementioned prior arts. The entire appearance of the paper clip and documents is therefore pleasing and integral.

Figure 6:
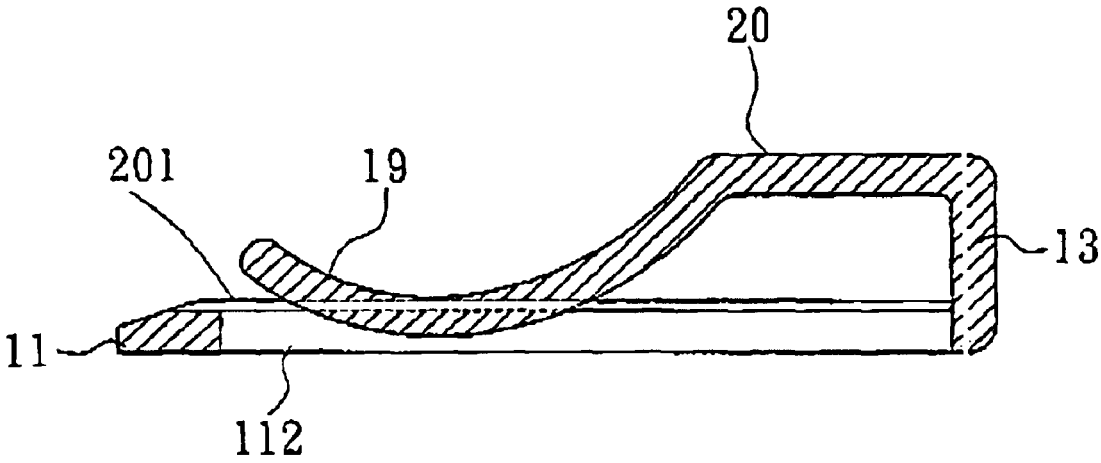
FIG. 6 is the sectional view of another preferred embodiment of the present invention.
Figure 7:
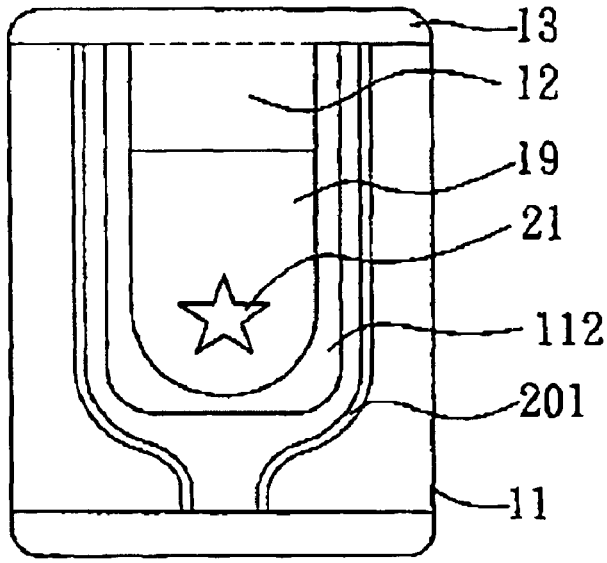
FIG. 7 is the top view of the embodiment in FIG. 6.

Referring to FIG. 6, which is the sectional view of another preferred embodiment of the present invention, and the embodiment is sort of improvement comparing to the embodiment shown in both FIGS. 4 and 5. The sunken slot 112 is a hollow type, and more clamping force can be put on. Two ridges 201 are set on the first clipping piece 11 for enhancing the hardness of the first clipping piece 11. Referring to FIG. 7, which is the top view of the embodiment in FIG. 6. As showing in the figure, the second clipping piece 12 is a little smaller than the sunken slot 112. Two ridges 201 are symmetrically distributed on the first clipping piece 11 to enhance the hardness of the first clipping piece 11. Further, a star logo 21 can be engraved on top of the curve part 19.

Figure 8:
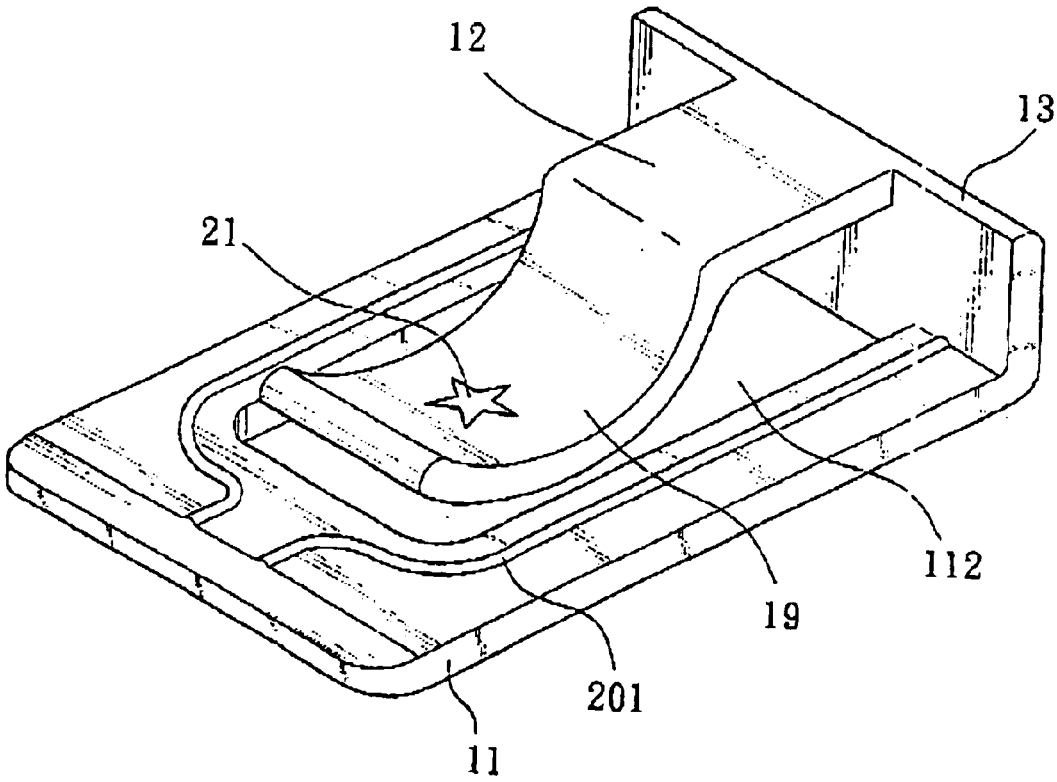
FIG. 8 is the 3-dimension view of the embodiment in FIG. 6.

Referring to FIG. 8, which is the 3-dimension view of the embodiment in FIG. 6. It could be clearly shown for the second preferred embodiment. Wherein, the first clipping piece 11, the support beam 13 and the second clipping piece 12 are formed in one module. The support beam 13 is as wide as the first clipping piece 11 to enhance a structure of the support beam 13. The second clipping piece 12 directly extends from the support beam 13 into the sunken slot 112.

Figure 9:
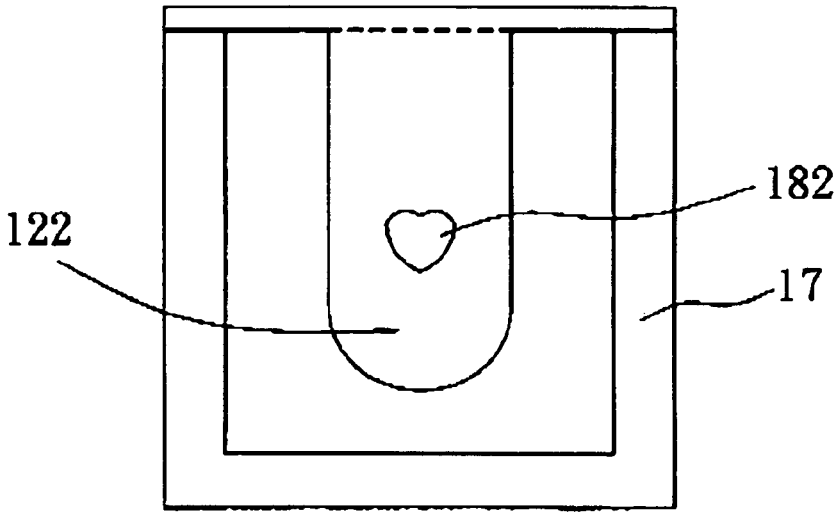
FIG. 9 is the top view of the preferred logo embodiment of the present invention.
Figure 10:
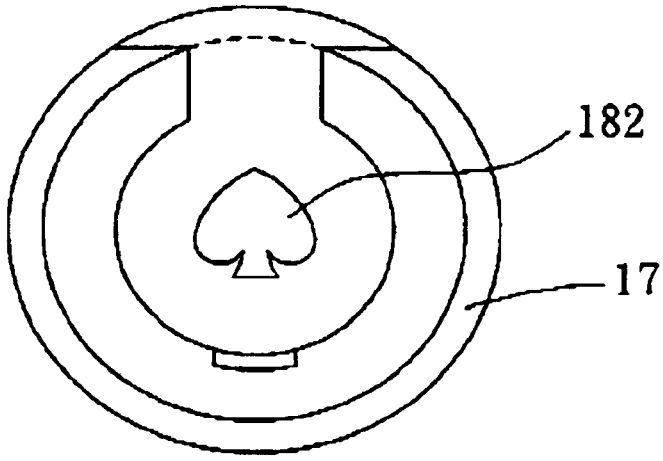
FIG. 10 is the top view of another preferred logo embodiment of the present invention.

Referring to FIG. 9, which is the top view of the preferred logo embodiment of the present invention. A logo 182 can be put on the top curve surface 122, and not on the first clipping piece 17. Therefore, the logo represents a company, group or personal sign, which is a sort of advertisement. The design is suitable for commercial use, memorial, gift, etc. FIG. 10 is the top view of another preferred logo embodiment of the present invention, which means a logo could be put in many types for different situations.

Figure 11:
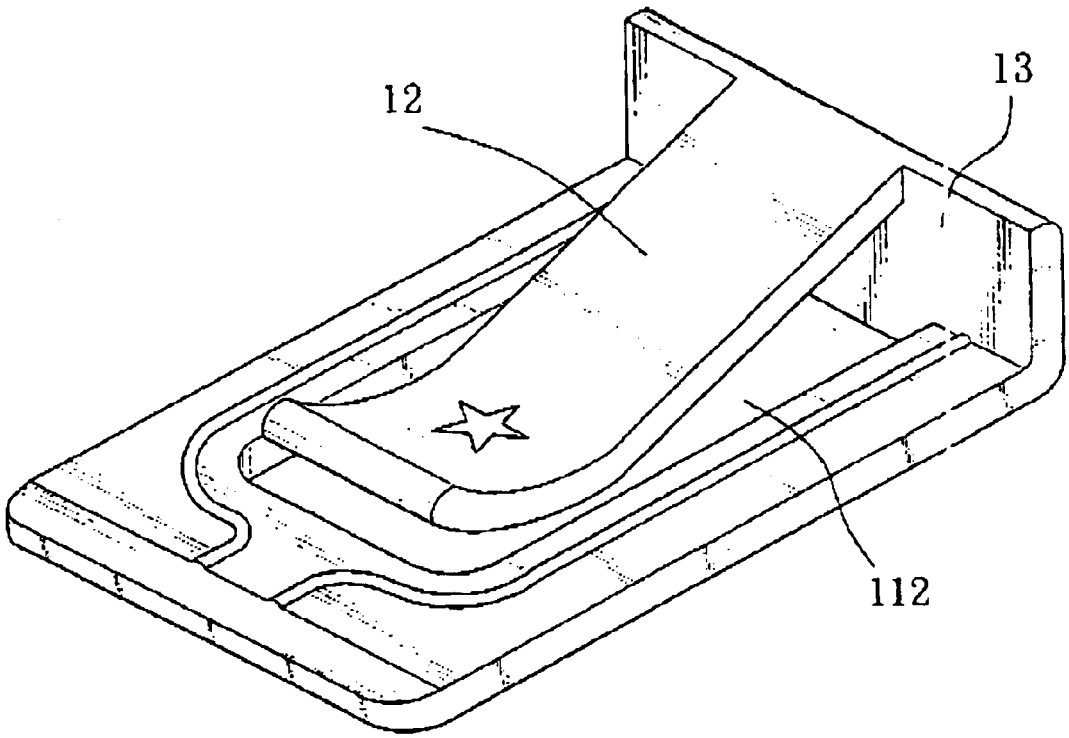
FIG. 11 is the 3-dimension view of another embodiment.

Referring to FIG. 11, which is the 3-dimension view of another embodiment. A difference with the embodiment in FIG. 8 is that the second clipping piece 12 is without the curve part 19, and the second clipping piece 12 directly extends from the support beam 13 into the sunken slot 112.

Figure 12:
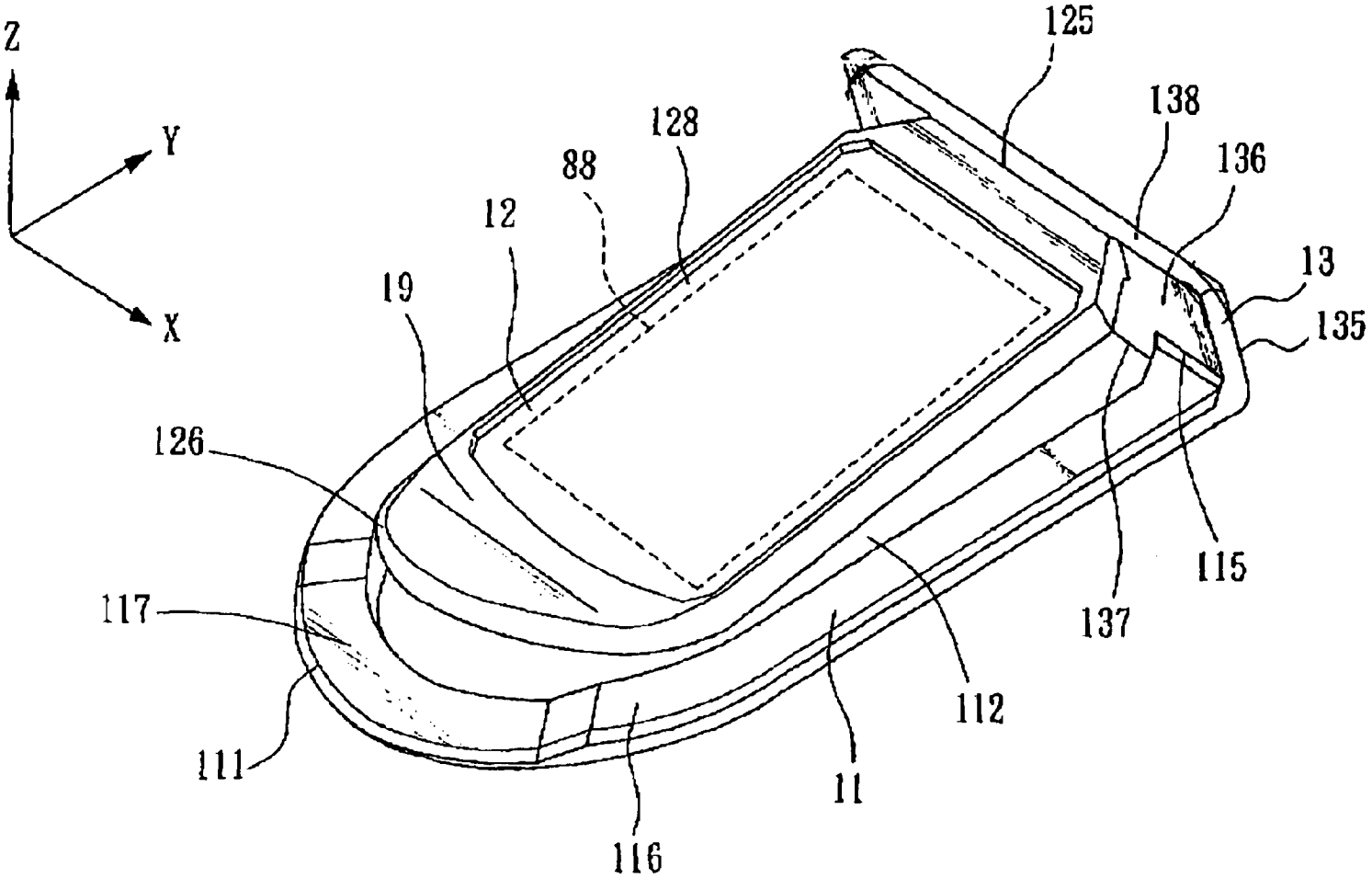
FIG. 12 is a 3-dimension view of yet another embodiment of the paper clip in accordance with the present invention.
Figure 13:
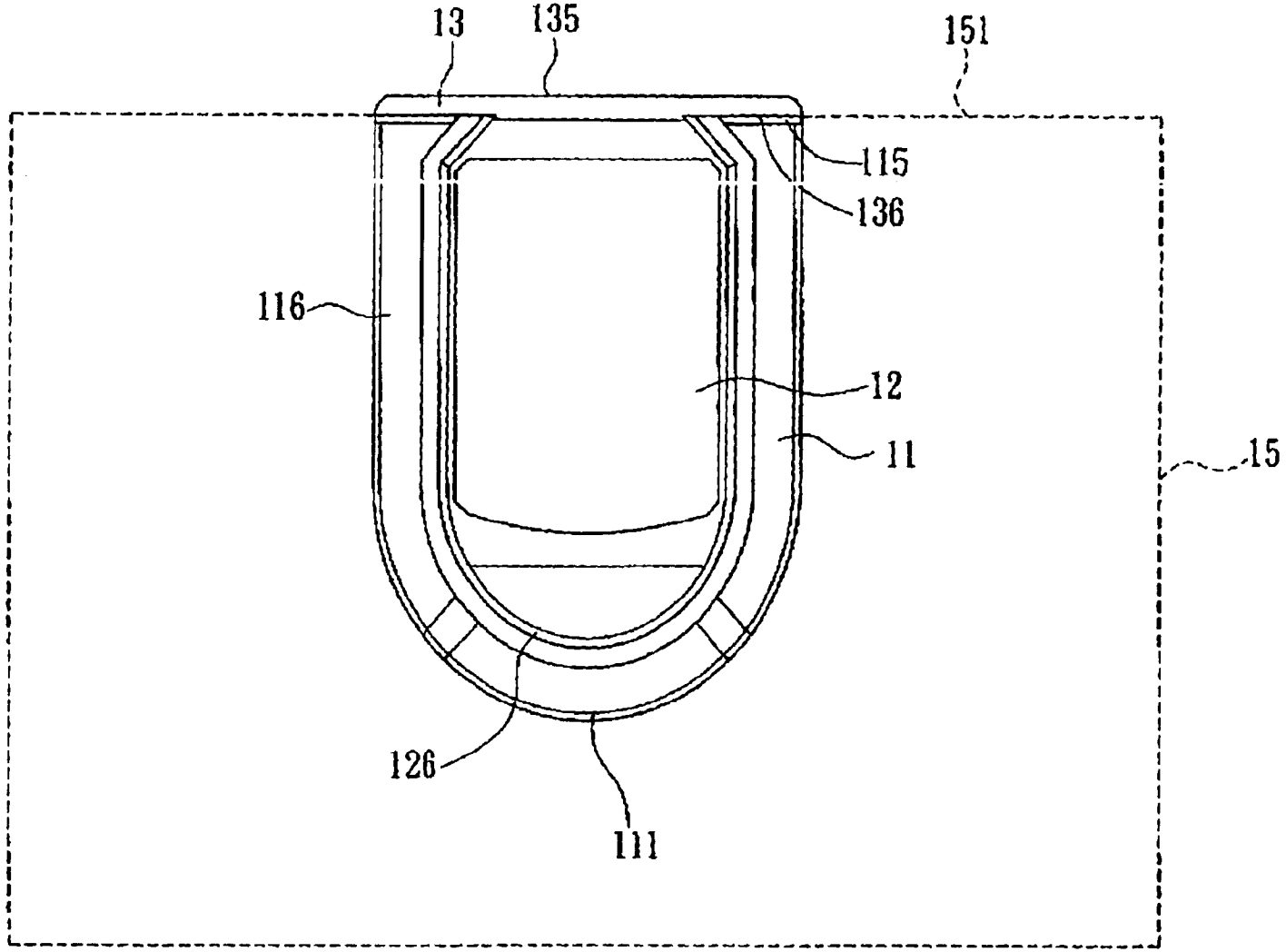
FIG. 13 is a top view of the paper clip shown in FIG. 12.

Please refer to FIGS. 12 and 13, which illustrate yet a further embodiment of the paper clip in accordance with the present invention. Similar to the one shown in FIG. 4, the paper clip shown in FIGS. 12 and 13 also comprises first clipping piece 11, second clipping piece 12 and support beam 13.

The first clipping piece 11 also includes a first end 115 (rear end) and a second end 111 (front end) along a length direction "Y". The first clipping piece 11 has a top surface 116 and a slot 112 (sunken slot) therethrough. The slot 112 extends from the first end 115 (i.e., from the inner surface 136 of the support beam 13) along the length direction "Y" to a position apart from the second end 111 such that the length of the slot 112 is substantially shorter than which of the first clipping piece 11. The slot 112 further has a width smaller than which of the first clipping piece 11. Furthermore, the second end 111 (front end) of the first clipping piece 11 is formed with a thinner portion 117 (i.e., has a thickness smaller than other parts of the first clipping piece 11) such that the documents 15 will be more easy to be received by the second end 111 (front end) of the paper clip.

The support beam 13 has an inner surface 136 facing the slot 112, an outer surface 135 opposite to the inner surface 136, a bottom (lower) side 137 and a top (upper) side 138. The two side sections of the bottom side 137 of the support beam 13 is adjoined to the two first ends 115 of the first clipping piece 11. The support beam 13 is a thin plate extending along a height direction "Z" which is roughly perpendicular to the length direction "Y". The support beam 13 further has a width which is substantially the same as which of the first clipping piece 11.

The second clipping piece 12 has a fixed end 125 and a free end 126 along the length direction "Y". The fixed end 125 of the second clipping piece 12 is adjoined to a center section of the top side 125 of the support beam 13 and is extending along the length direction "Y" in such a manner that a length distance between the free end 126 and the support beam 13 is no larger than the length of the slot 112. The second clipping piece 12 also has a curved part 19 which is partially located within the slot 112. The second clipping piece 12 further has a width which is smaller than the slot 112. The top surface of the second clipping piece 12 is further formed with a recessed area 128 which typically has a depth of around 0.1~1.0 mm (e.g., the thickness of a sticker). Users can stick a pre-designed sticker or label 88 on the recessed area 128 for distinguishing the kinds of documents being held by the paper clip. Since the recessed area 128 has a depth which is about the same or larger thickness of the sticker/label 88, therefore the top surface of the second clipping piece 12 will remain a flat plane after the sticker/label 88 is attached. Therefore, the corners of the sticker/label 88 won't tend to be lifted easily by friction.

Preferably, the inner surface 136 of the support beam 13 is a flat plane which is roughly in perpendicular to the top surface 116 of the first clipping piece 11. Such that the inner surface 136 substantially provides a guiding function when documents are received between the first and second clipping pieces 11, 12 (as shown in FIG. 13) so as to make a leading edge 151 of the documents 15 being flush with the inner surface 136 of the support beam 13 in the height direction "Z". As a result, the leading edge 151 of the documents 15 will be straightly stocked in the height direction "Z".

It is particularly notable that, when taking the projection view of the paper clip along the height direction, the projection of the first end 115 of the first clipping piece 11 does not overlap with which of the fixed end 125 of the second clipping piece 12 at all. Such kind of structural design makes the paper clip of the present invention easy to be manufactured by plastic ejection. Moreover, the first end 115 of the first clipping piece 11 and the fixed end 125 of the second clipping piece 12 are both adjoined to the inner surface 136, such that the outer surface 135 of the support beam 13 substantially forms the rear side of the outer contour of the paper clip.

As a conclusion of the aforesaid embodiments, the present invention can be widely applied on different thicknesses of documents and fields for representing their signs. Further, the above descriptions are the preferable embodiments of the present invention. The covered scopes of the present invention are not restricted on the embodiments shown in the present invention. All the changes according to the contents of the present invention, such as: the change of shapes or locations of the arrangement of the fastening structures, etc., the generated functions and characteristics similar to those of the embodiments of the present invention and any ideas thought by the persons well-known such technologies are all within the scopes of the present invention.

What is claimed is:

1. A paper clip for clamping a document, comprising:

a first clipping piece having first and second ends along a length direction, said first clipping piece having a top surface and a slot therethrough, said slot extending from said first end along the length direction to a position apart from the second end such that a length of the slot is shorter than a length of the first clipping piece, the slot further having a width smaller than a width of the first clipping piece;

a support beam having an inner surface adjoining the slot, an outer surface opposite to the inner surface, a lower side and an upper side, said support beam having its lower end adjoined to the first end of the first clipping piece and extending along a height direction which is perpendicular to the length direction, the lower side of support beam further having a width which is substantially the same as the width of the first clipping piece; and a second clipping piece having a fixed end and a free end along the length direction, said second clipping piece having its fixed end adjoined to an upper end of the support beam and extending along the length direction in such a manner that a length distance between the free end and the support beam is no longer than the length of the slot, the second clipping piece having a curved part which is partially located within the slot, the second clipping piece further having a width which is smaller than the width of the slot;

wherein the inner surface of the support beam is a flat plane in perpendicular to the length direction, such that the inner surface substantially provides a guiding function when the document is received between the first and second clipping pieces so as to make a leading edge of the document being flush with the inner surface;

wherein, a projection of the first end of the first clipping piece does not overlap with width of the fixed end of the second clipping piece in the height direction;

wherein the first end of the first clipping piece and the fixed end of the second clipping piece are both adjoined to the inner surface, such that the outer surface of the support beam substantially forms part of the outer contour of the paper clip, wherein the support beam is as wide as the width of the first clipping piece.

2. The paper clip of claim 1, the top surface of the first clipping piece has a thinner portion at the second end for receiving at least a document therefrom.

3. The paper clip of claim 1, wherein the second clipping piece has a recessed area formed on a upper surface thereof, said recessed area has a depth of around 0.01 to 1.0 mm for attaching a sticker thereon.

4. The paper clip of claim 1, wherein a bottom surface of the second clipping piece is a roughened surface.

5. An improved paper clip for clamping a document, comprising:

a first clipping piece having a thin plane shape with a sunken slot for placing documents and being a lower part of the paper clip, the sunken slot being as a hollow type with a length and a width;

a second clipping piece having a thin plane shape and being an upper part of the paper clip, the second clipping piece being protruded downward to the sunken slot of the first clipping piece, the length of the second clipping piece being smaller than the length of the sunken slot of the first clipping piece, and the width of the second clipping piece being smaller than the width of the sunken slot of the first clipping piece; and a support beam having a vertical plane with certain height and individually connecting to the first and second clipping pieces in top view; connected ends of the support beam and the clipping pieces being located on an opposite side to a side where documents being inserted in; a rear end of said sunken slot of the first clipping piece being merged with the support beam, wherein the support beam is as wide as the clipping piece.

6. The improved paper clip as cited in claim 5, wherein, the certain height of support beam is available for different thicknesses of documents.

7. The improved paper clip as cited in claim 5, wherein, the first clipping piece has a thinner portion at a front end where documents being inserted in.

8. The improved paper clip as cited in claim 5, wherein, the second clipping piece has a recessed area with a depth of around 0.01 to 1.0 mm for attaching a sticker thereon.

9. The paper clip of claim 5, wherein a bottom surface of the second clipping piece is a roughened surface.

* * * * *